US009080298B2

(12) United States Patent
Yu et al.

(10) Patent No.: US 9,080,298 B2
(45) Date of Patent: Jul. 14, 2015

(54) RETAINING WALL CONSTRUCTION SYSTEM FOR PREVENTING TSUNAMIS AND FLOOD DAMAGES AND CONSTRUCTION METHOD THEREOF

(75) Inventors: Heung Sik Yu, Gyeonggi-do (KR); Seong Kyun Jin, Seoul (KR)

(73) Assignees: KGC CO., LTD., Gyeonggi-Do (KR); Heung Sik Yu, Gyeonggi-Do (KR); Seong Kyun Jin, Seoul (KR); ECO-TOP CO., LTD., Kyungbuk (KR)

( * ) Notice: Subject to any disclaimer, the term of this patent is extended or adjusted under 35 U.S.C. 154(b) by 0 days.

(21) Appl. No.: 13/817,594

(22) PCT Filed: Sep. 8, 2010

(86) PCT No.: PCT/KR2010/006086
§ 371 (c)(1),
(2), (4) Date: Feb. 19, 2013

(87) PCT Pub. No.: WO2012/023650
PCT Pub. Date: Feb. 23, 2012

(65) Prior Publication Data

US 2013/0149037 A1 Jun. 13, 2013

(30) Foreign Application Priority Data

Aug. 17, 2010 (KR) ..... 10-2010-0079390

(51) Int. Cl.

| | |
|---|---|
| ***E02D 29/02*** | (2006.01) |
| ***E02B 3/12*** | (2006.01) |
| ***E02B 3/14*** | (2006.01) |
| ***E02B 3/10*** | (2006.01) |

(52) U.S. Cl.
CPC ... *E02B 3/12* (2013.01); *E02B 3/10* (2013.01); *E02B 3/14* (2013.01); *E02D 29/02* (2013.01); *E02D 29/0266* (2013.01)

(58) Field of Classification Search
CPC ... E02D 29/02; E02D 29/025; E02D 29/0266; E02B 3/10; E02B 3/14
USPC ..... 405/284, 286, 17, 31; 52/603, 604
See application file for complete search history.

(56) References Cited

U.S. PATENT DOCUMENTS

| | | | | | |
|---|---|---|---|---|---|
| 635,906 | A | * | 10/1899 | Wilson | 405/286 |
| 2,892,340 | A | * | 6/1959 | Fort | 405/286 |
| 3,873,225 | A | * | 3/1975 | Jakobsen et al. | 52/604 |
| 4,172,680 | A | * | 10/1979 | Brown | 405/16 |
| RE32,663 | E | * | 5/1988 | Atkinson | 405/16 |

(Continued)

FOREIGN PATENT DOCUMENTS

| | | |
|---|---|---|
| JP | 06311821 | 8/1994 |
| JP | 10-046549 A | 2/1998 |

(Continued)

*Primary Examiner* — Frederick L Lagman
(74) *Attorney, Agent, or Firm* — Revolution IP, PLLC

(57) ABSTRACT

Disclosed is a retaining wall construction system for preventing tsunamis and flood damages and a construction method thereof. The retaining wall construction system includes hexagonal multi-layered interlocking blocks built in a plurality of lines for forming a retaining wall, wherein S-shaped connection sections are formed on an outer periphery for a plurality of interlocking blocks, and hexagonal multi-layered interlocking blocks, which are adjacent to each other and different from each other, are connected to each other via the S-shaped connection sections to be movable in the vertical direction.

4 Claims, 12 Drawing Sheets

(56) References Cited

U.S. PATENT DOCUMENTS

| | | | | | |
|---|---|---|---|---|---|
| 4,801,220 | A | | 1/1989 | Bores | |
| 4,875,803 | A | * | 10/1989 | Scales | 405/16 |
| 4,964,761 | A | * | 10/1990 | Rossi | 405/286 |
| 4,997,308 | A | * | 3/1991 | Welling, Jr. | 52/603 |
| 5,251,560 | A | * | 10/1993 | Ban et al. | 405/16 |
| 5,413,435 | A | * | 5/1995 | Batlle | 405/284 |
| 5,651,642 | A | * | 7/1997 | Kelley et al. | 405/286 |
| 5,678,958 | A | * | 10/1997 | Rossi | 405/286 |
| 5,902,069 | A | * | 5/1999 | Barth et al. | 52/603 |
| 6,048,139 | A | * | 4/2000 | Donovan, III | 405/284 |
| 7,637,688 | B2 | * | 12/2009 | Riccobene | 52/596 |

FOREIGN PATENT DOCUMENTS

| | | | |
|---|---|---|---|
| JP | 2002-138500 | A | 5/2002 |
| KR | 200249169 | | 10/2001 |
| KR | 200341409 | | 2/2004 |

* cited by examiner

*-Conventional Art-*

*-Conventional Art-*

*-Conventional Art-*

RETAINING WALL CONSTRUCTION SYSTEM FOR PREVENTING TSUNAMIS AND FLOOD DAMAGES AND CONSTRUCTION METHOD THEREOF

CROSS-REFERENCE TO RELATED APPLICATION

This application claims the benefit of Korean Patent Application No. 10-2010-0079390, filed on Aug. 17, 2010 in the Korean Intellectual Property Office, the disclosure of which is incorporated herein by reference.

TECHNICAL FIELD

The present invention relates to a retaining wall construction system for preventing tsunamis and flood damages and construction method thereof and in particular to a retaining wall construction system for preventing tsunamis and flood damages and construction method thereof which have features in that a foundation pothole formation, a sweep and an inversion can be prevented by interlocking blocks, and a foundation pothole formation, a sweep and an inversion by waves and rain water can be prevented by constructing an embankment and a retaining wall at a shore, a river and a land with a hexagonal block, a hexagonal and multilayer block, a pentagonal block and a tetragonal block which are good at a horizontal, vertical interlocking operation. A very stable embankment and retaining wall can be built thanks to a geometric and structure-engineered feature consisting of an interlocking assembly structure of an S-shaped connection part, a stair type structure, a stable downward weight center type structure, a counter fort type structure, a flower garden type structure and a pillar-mixed type when tsunamis (submarine earthquake), a flood, and earthquake, etc. occurs.

BACKGROUND ART

In the 21st century, a natural disaster such as a huge flood, an earthquake, tsunamis (submarine earthquake), etc. occurs throughout the world, causing tremendous damages.

An effective prevention method or a construction method is not yet developed until now, so the damages continue to increase. We can dare say that no places in the world are stable from the natural disaster.

When tsunamis occurs owing to the earthquake at the sea and hits a part of lowland near a shore, there is not any means to prevent such tsunamis. The regions that the tsunamis hit are terribly devastated not leaving any traces of a facility or people, so such devastated regions look miserable and are hard to recover.

The above mentioned problems cannot be resolved with a so-far developed conventional technology, and since it takes a long construction period and a huge amount of construction costs is required, so a regrettable and unhappy accident does not stop in the world.

FIGS. 1 to 3 are cross sectional views illustrating a state that a conventional embankment is destroyed owing to the erosion by seawater when waves or rainwater hit. In case of an ordinary embankment, as the erosion at the lower side of the embankment repeats owing to waves or running water, the embankment is likely to be destroyed as shown in FIG. 1.

DISCLOSURE OF INVENTION

Accordingly, the present invention is made to overcome the above described problems, and it is an object of the present invention to provide a retaining wall construction system for preventing tsunamis and flood damages and construction method thereof which have features in that a foundation pothole formation, a sweep and an inversion can be fundamentally prevented from waves and running water in such a way to build a prefabrication type embankment and a retaining wall at a shore, a river and a land by using a hexagonal block, a hexagonal and multilayer block, a pentagonal block and a tetragonal block which are good at a horizontal, vertical interlocking operation. In particular, an interlocked block serves to block a pothole space as it moves down like a shutter when a foundation part has a pothole and is swept owing to waves and running water, so the lower side of the foundation structure can last semi-permanently providing a stable structure. The structures of a space between S-shaped connection parts, a stair, a stable downward weight center type, a counter fort, a flower garden, a pillar-mixed type are very stable in terms of a geometric and structurally engineered structure for thereby effectively preventing the potential damages from the natural disaster such as flood, tsunamis, earthquake, etc. The construction period and construction cost can be saved a lot by in such a way that the blocks are just engaged with each other, and the wide space of each block body may be filled with gravel, sand, soil, etc. produced at the site and may be used as a planting space for thereby building an environment friendly embankment and a retaining wall.

To achieve the above objects, according to a first embodiment of the present invention, there is provided a retaining wall construction system for preventing tsunamis and flood damages, comprising a hexagonal multilayer interlocking block on an outer circumferential surface of which are provided a plurality of interlocking block S-shaped connection part, and another neighboring hexagonal multilayer interlocking block is engaged to move upwards and downwards via the S-shaped connection part, and a retaining wall is made by constructing the hexagonal multilayer interlocking blocks in multiple rows.

The hexagonal multilayer interlocking block is configured to fill an eroded portion as it moves downwards even when a lower side of a retaining wall or an embankment is eroded by seawater, and the outer circumferential surface of which is formed with the areas of six hexagonal pillar type blocks, the hexagonal multilayer interlocking block being hollow.

In addition, according to a second embodiment of the present invention, there is provided a retaining wall construction system for preventing tsunamis and flood damages and construction method thereof, comprising a stable downward weight center type block which is a block partitioned into three spaces each passing through from the top to the bottom, and inner and outer partition portions are partitioned about a center partition portion, and at both sides of the center partition portion is formed a center S-shaped connection part, so it is engaged with a neighboring block, and at both sides of each of the inner and outer partition portions are formed upper and lower S-shaped connection parts, so it is engaged with a neighboring block.

Both sides of each of the inner and outer partition portions are formed with angles $\alpha$ narrower than both sides of the center partition portion for the stable downward weight center type blocks to be connected in a curved shape.

At a side surface of a longitudinal direction of the inner partition portion of the stable downward weight center type block is provided a longitudinal direction S-shaped connection part engaged to the hexagonal pillar type block.

At a side surface of a longitudinal direction of an outer partition portion of the stable downward weight center type block is provided a longitudinal direction S-shaped connection part engaged with the hexagonal pillar type block.

There is further provided a repose angle inclination type lower block provided at the lower most portion of the stable downward weight center type block in which a retaining wall is constructed in multiple layers, and the height "h" at the side of the inner partition portion at the side of the retaining wall is lower than the height "H" at the side of the outer partition portion, and a repose angle β inclined toward the retaining wall with respect to a vertical line is provided in the repose angle inclination type lower block.

The method for constructing a retaining wall construction system for preventing tsunamis and flood damages comprises mixing gravel, sand or soil and sand; filling the mixture into an inner partition part near an inclined surface up to the top of it; filling the mixture into a center partition part up to the middle of it; and filling the mixture into an outer partition part up to ⅓ of the height of a retaining wall for thereby constructing a retaining wall the weight center of which is stabilized downwards. The hexagonal multilayer interlocking block moves downwards and fills the eroded portions even when the lower side of the retaining wall or the embankment is eroded by seawater, and six hexagonal pillar blocks are inserted into the inner surface.

Advantageous Effects

According to the retaining wall construction system for preventing tsunamis and flood damages and construction method thereof of the present invention, the present invention are characterized in that a foundation pothole formation, a sweep and an inversion can be fundamentally prevented from waves and rainwater in such a way to build a prefabrication type embankment and a retaining wall at a shore, a river and a land by using a hexagonal block, a hexagonal and multilayer block, a pentagonal block and a tetragonal block which are good at a horizontal, vertical interlocking operation. In particular, an interlocked block serves to block a pothole space as it moves down like a shutter when a foundation part has a pothole and is swept owing to waves and rainwater, so the lower side of the foundation structure can last semi-permanently providing a stable structure. The structures of a space between S-shaped connection parts, a stair, a stable downward weight center type, a counter fort, a flower garden, a pillar-mixed type are very stable in terms of a geometric and structurally engineered structure for thereby effectively preventing the potential damages from the natural disaster such as flood, tsunamis, earthquake, etc. The construction period and construction cost can be saved a lot by in such a way that the blocks are just engaged with each other, and the wide space of each block body may be filled with gravel, sand, soil, etc. produced at the site and may be used as a planting space for thereby building an environment friendly embankment and a retaining wall.

BEST MODES FOR CARRYING OUT THE INVENTION

Figure 1:
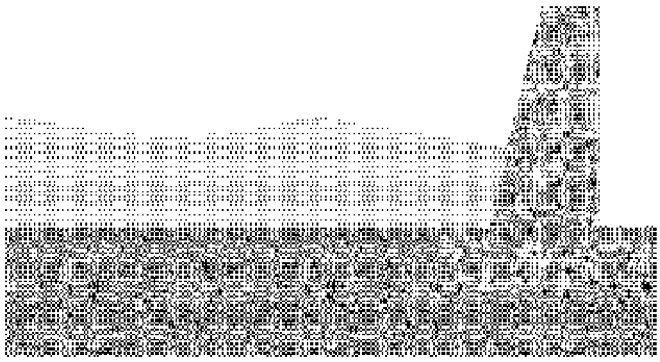
FIGS. 1 to 3 are cross sectional views illustrating a conventional retaining wall.

According to a first embodiment of the present invention, there is provided a retaining wall construction system for preventing tsunamis and flood damages, comprising a hexagonal multilayer interlocking block 10 on an outer circumferential surface of which are provided a plurality of interlocking block S-shaped connection parts 11, and another neighboring hexagonal multilayer interlocking block 10 is engaged to move upwards and downwards via the S-shaped connection part 11, and a retaining wall is made by constructing the hexagonal multilayer interlocking blocks 10 in multiple rows.

According to a second embodiment of the present invention, there is provided a retaining wall construction system for preventing tsunamis and flood damages and construction method thereof, comprising a stable downward weight center type block 30 which is a block partitioned into three spaces each passing through from the top to the bottom, and inner and outer partition portions 32 and 33 are partitioned about a center partition portion 31, and at both sides of the center partition portion 31 is formed a center S-shaped connection part 31*a*, so it is engaged with a neighboring block, and at both sides of each of the inner and outer partition portions 32 and 33 are formed upper and lower S-shaped connection parts 32*a* and 33*a*, so it is engaged with a neighboring block.

MODES FOR CARRYING OUT THE INVENTION

The preferred embodiments of the present invention will be described with reference to the accompanying drawings. In the course of the descriptions of the present invention, when it is judged that the related and known construction or function might make unclear the subject matters of the present invention, the descriptions thereon will be omitted.

EMBODIMENTS

Figure 4:
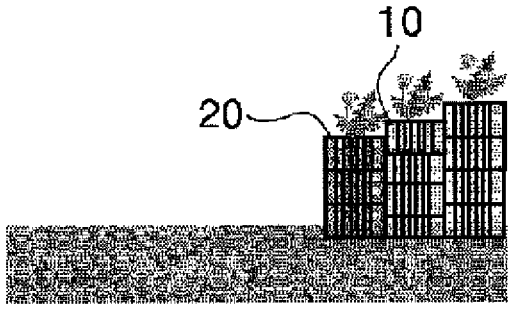
FIGS. 4 to 6 are cross sectional views illustrating a retaining wall according to the present invention.
Figure 5:
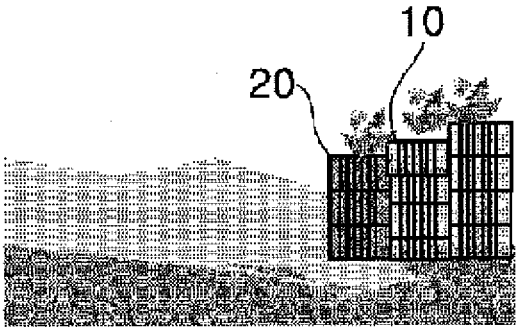
Figure 6:
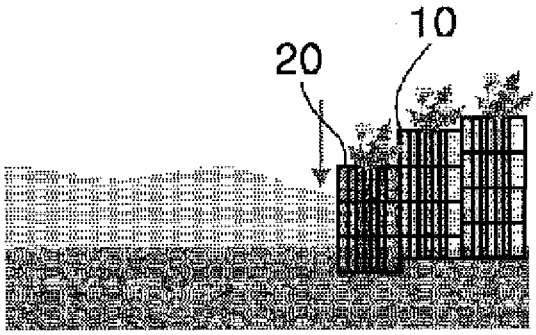
Figure 7:
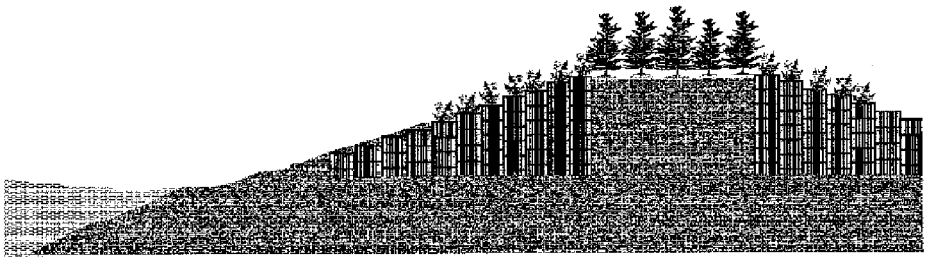
FIG. 7 is a cross sectional view illustrating a retaining wall according to another embodiment of the present invention.
Figure 8:
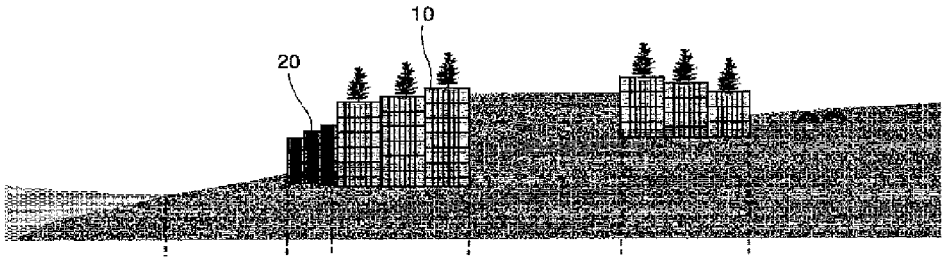
FIGS. 8 and 9 are a cross sectional view and a plane view illustrating a construction that a retaining wall is constructed with a hexagonal pillar shaped block and a hexagonal multilayer interlocking block according to the present invention.
Figure 9:
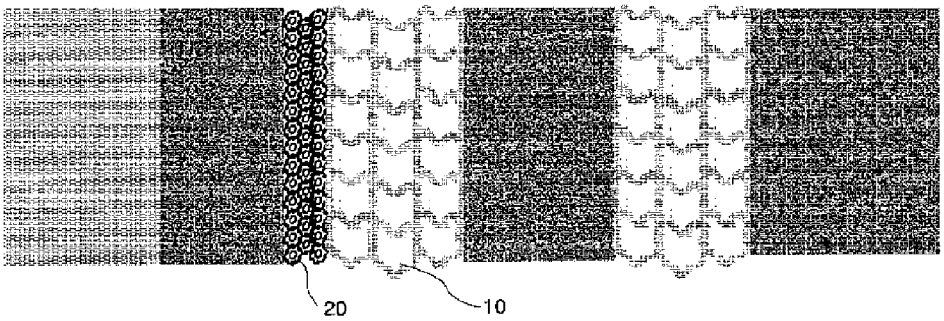
Figure 10:
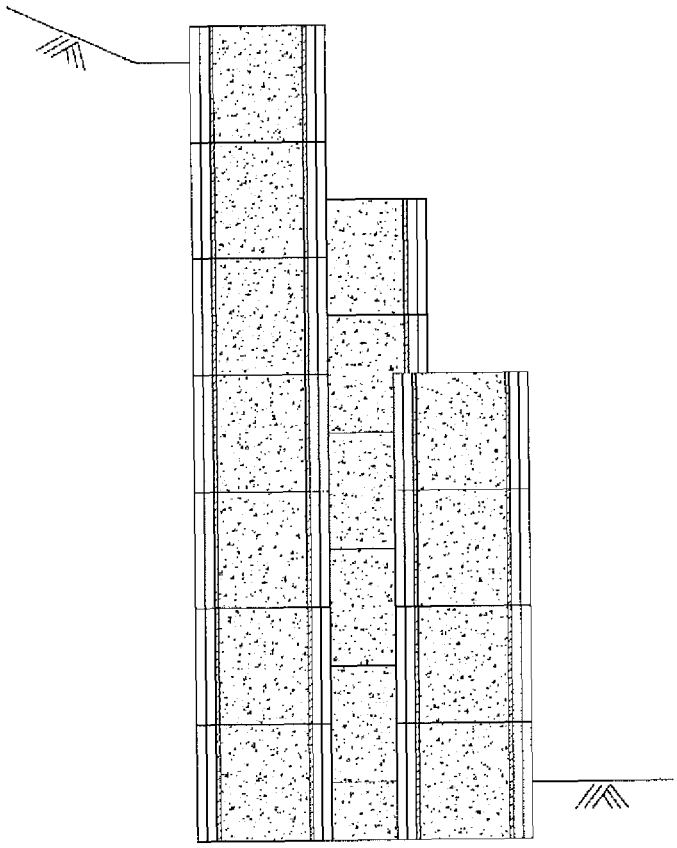
FIG. 10 is a cross sectional view illustrating a construction that a stair type retaining wall is constructed with a hexagonal interlocking block according to the present invention.
Figure 11:
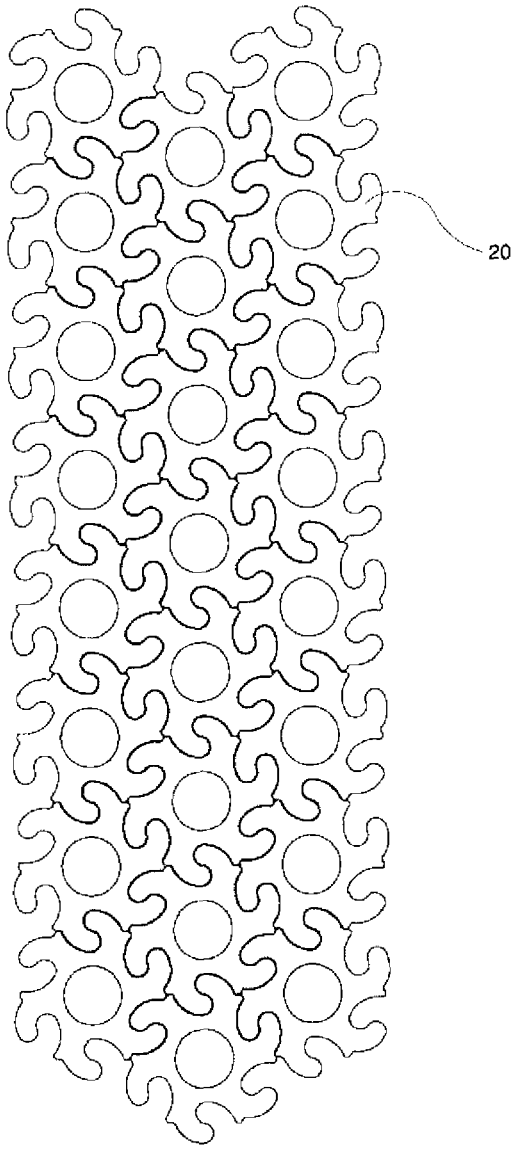
FIG. 11 is a plane view illustrating a construction that a stair type retaining wall is constructed with a hexagonal pillar type block according to the present invention.
Figure 12:
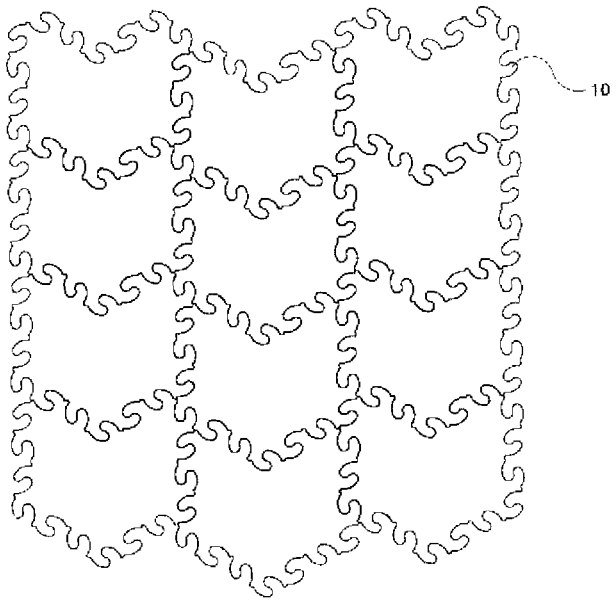
FIG. 12 is a plane view illustrating a construction that a stair type retaining wall is constructed with a hexagonal multilayer interlocking block according to the present invention.
Figure 13:
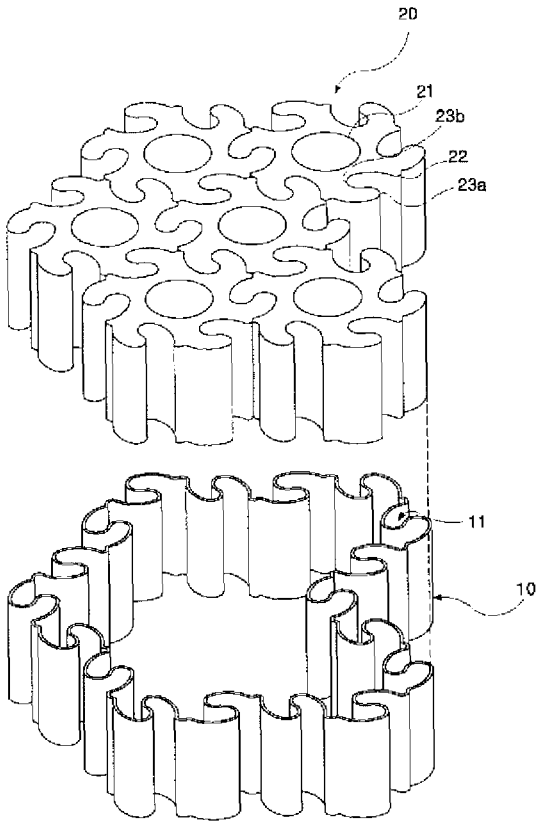
FIG. 13 is a perspective view illustrating an empty hexagonal multilayer interlocking block forming an outer circumferential surface with the aid of the area of six hexagonal pillar type blocks of the present invention.
Figure 14:
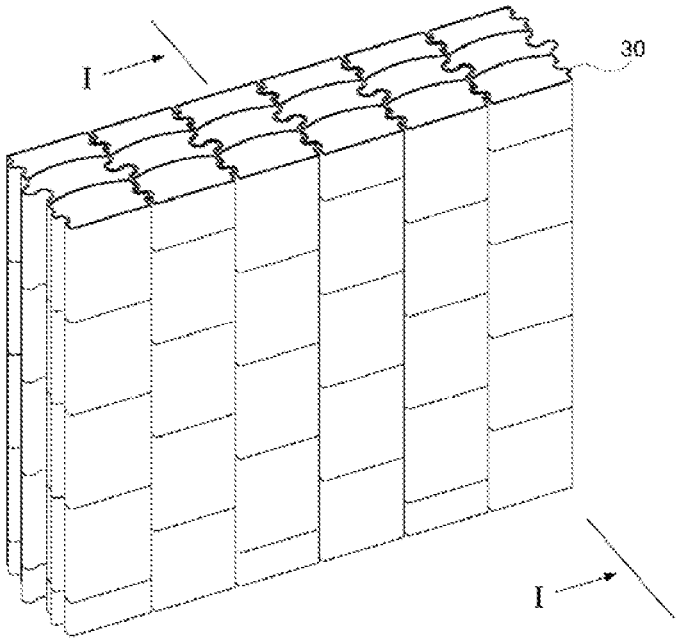
FIG. 14 is a perspective view illustrating a construction that a retaining wall is constructed with a stable downward weight center type block according to the present invention.
Figure 15:
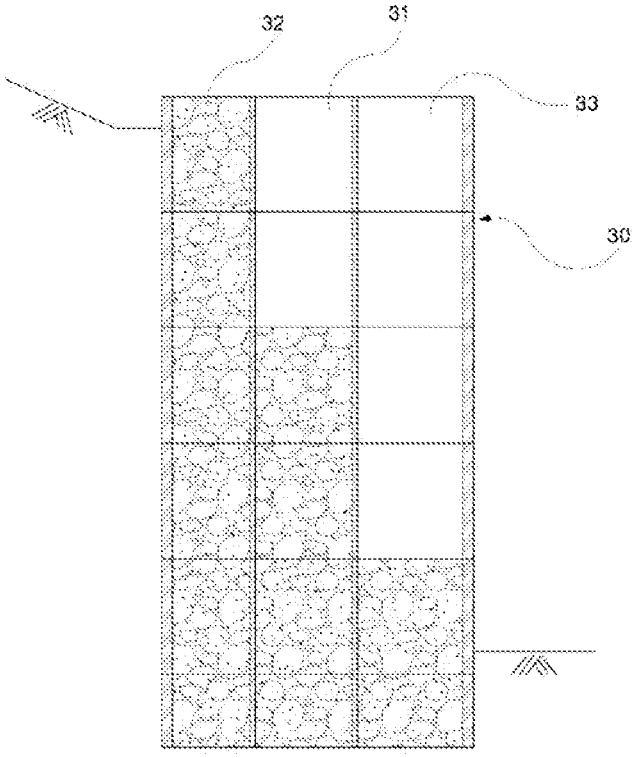
FIG. 15 is a cross sectional view illustrating a stable downward weight center type block according to the present invention.
Figure 16:
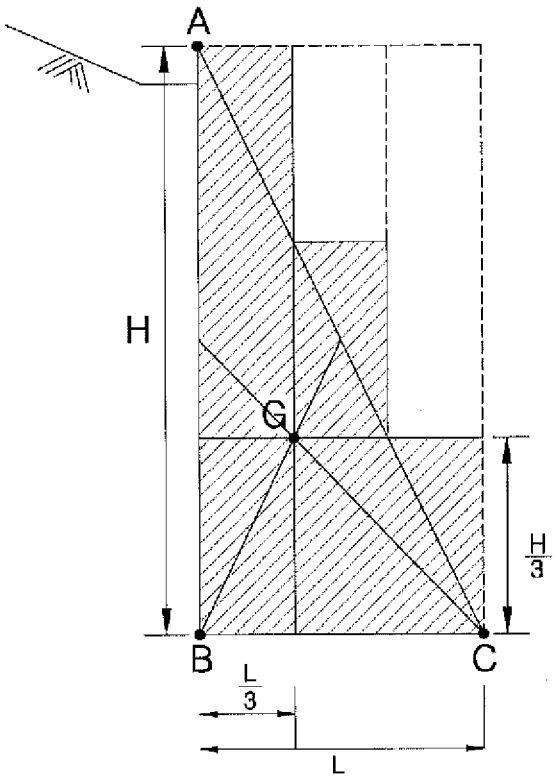
FIG. 16 is a view illustrating a weight center of a stable downward weight center type block according to the present invention.
Figure 17:
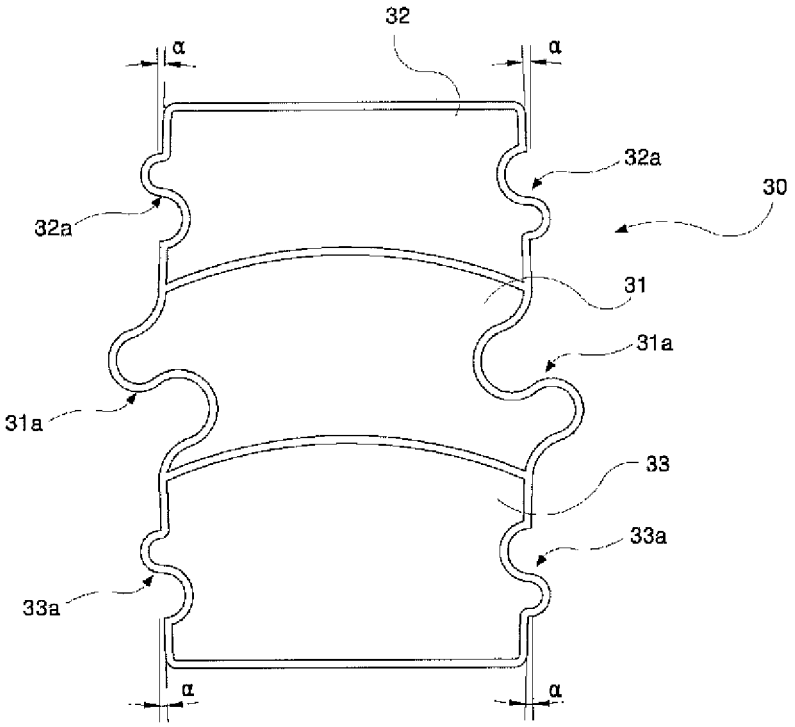
FIG. 17 is a plane view illustrating a stable downward weight center type block according to the present invention.
Figure 18:
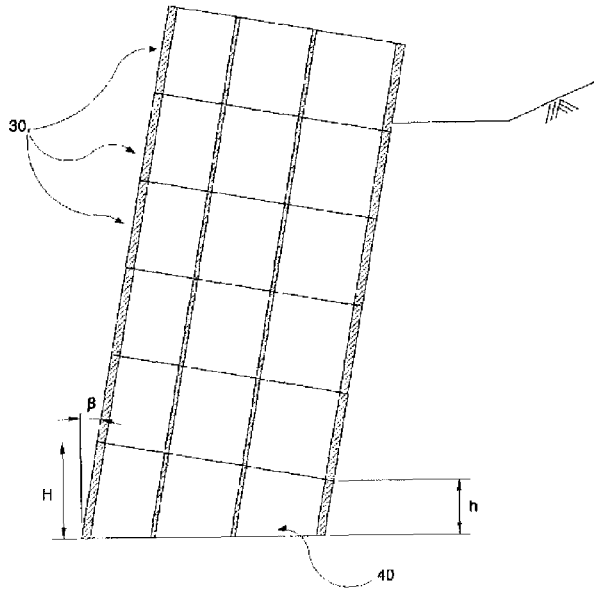
FIG. 18 is a cross sectional view illustrating a construction that a repose angle inclination type block is constructed at the lower most portion of a stable downward weight center type block according to the present invention.
Figure 19:
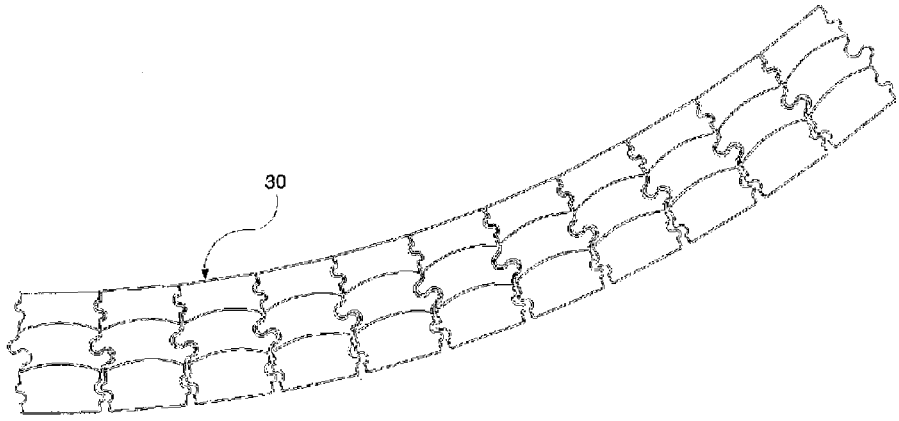
FIG. 19 is a plane view illustrating an example that a stable downward weight center type block is constructed in a curved shape according to the present invention.
Figure 20:
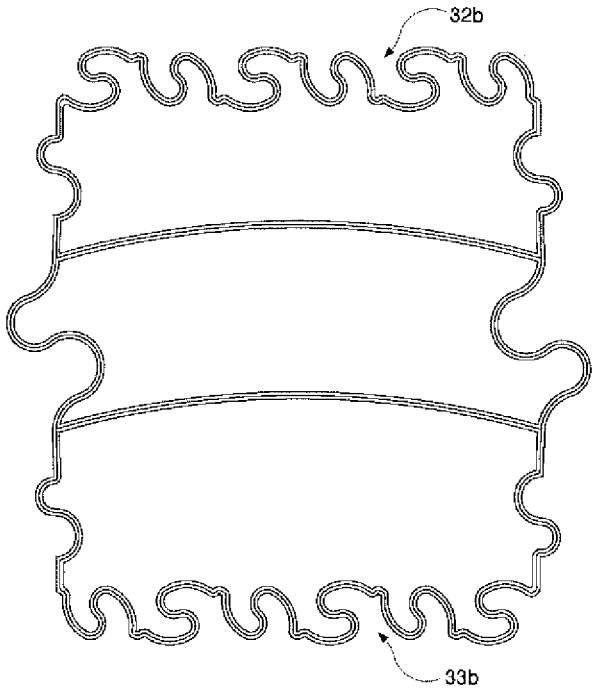
FIG. 20 is a view illustrating another type of a stable downward weight center type block according to the present invention.
Figure 21:
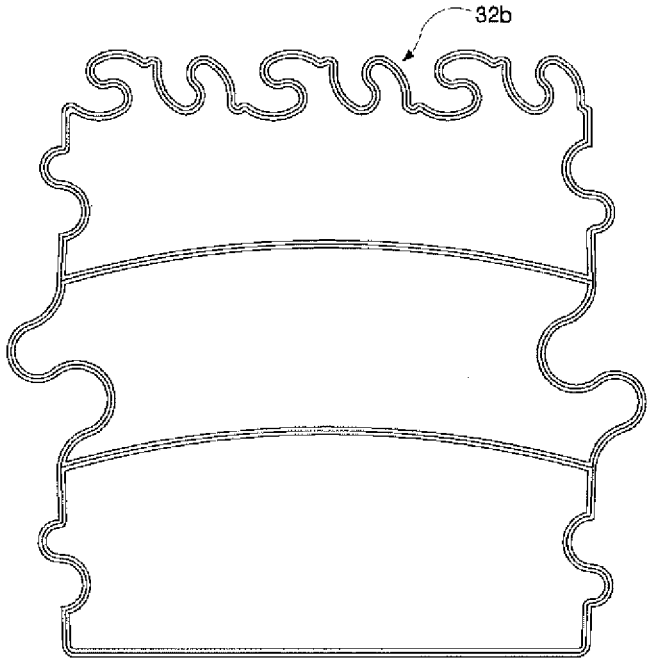
FIG. 21 is a view illustrating further another type of a stable downward weight center type block according to the present invention.
Figure 22:
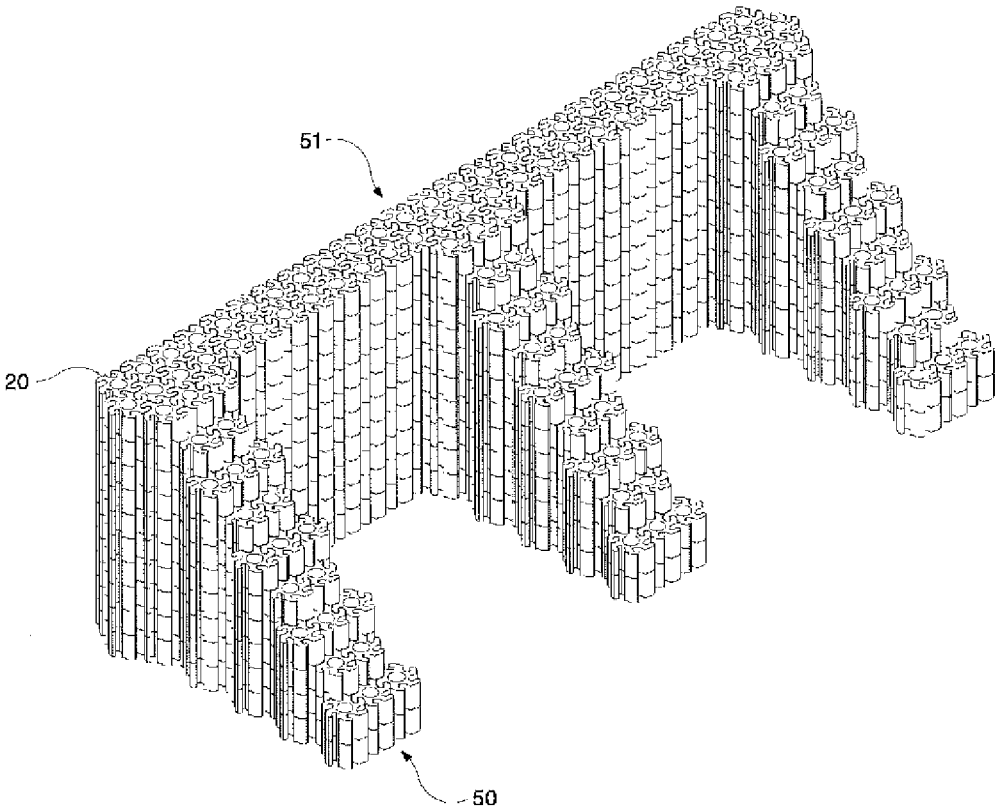
FIG. 22 is a perspective view illustrating a counter fort type retaining wall according to the present invention.
Figure 23:
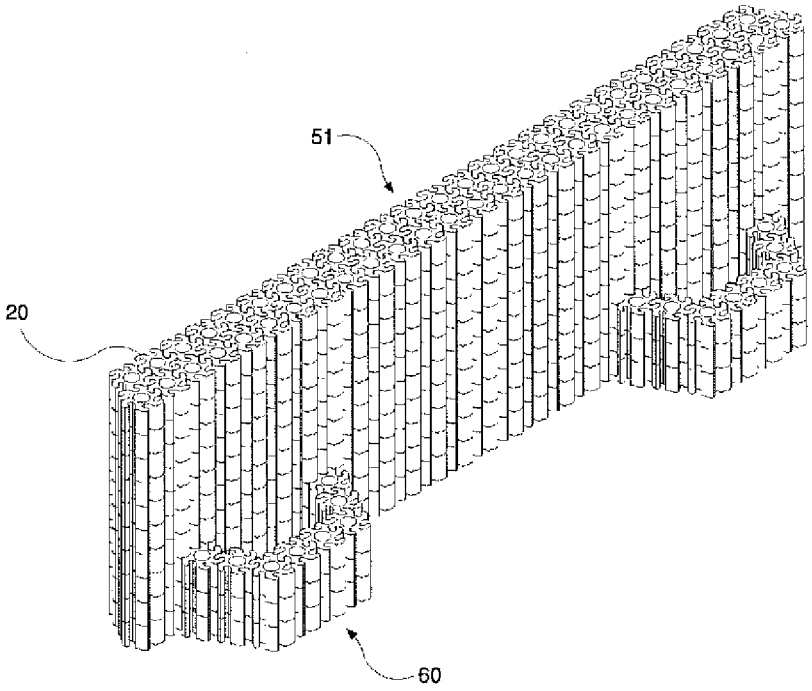
FIG. 23 is a perspective view illustrating a flower garden type retaining wall according to the present invention.
Figure 24:
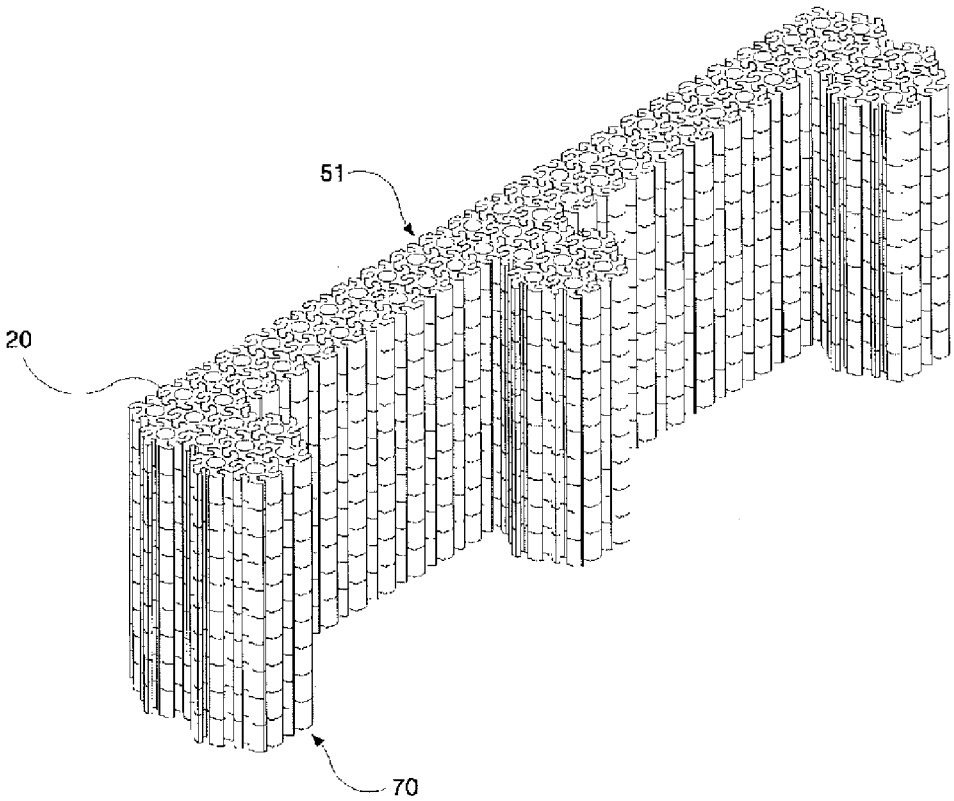
FIG. 24 is a perspective view illustrating a pillar mixed type retaining wall according to the present invention.

FIGS. 4 to 6 are cross sectional views illustrating a retaining wall according to the present invention. FIG. 7 is a cross sectional view illustrating a retaining wall according to another embodiment of the present invention. FIGS. 8 and 9 are a cross sectional view and a plane view illustrating a construction that a retaining wall is constructed with a hexagonal pillar shaped block and a hexagonal multilayer interlocking block according to the present invention. FIG. 10 is a cross sectional view illustrating a construction that a stair type retaining wall is constructed with a hexagonal interlocking block according to the present invention. FIG. 11 is a plane view illustrating a construction that a stair type retaining wall is constructed with a hexagonal pillar type block according to the present invention. FIG. 12 is a plane view illustrating a construction that a stair type retaining wall is constructed with a hexagonal multilayer interlocking block according to the present invention. FIG. 13 is a perspective view illustrating an empty hexagonal multilayer interlocking block forming an outer circumferential surface with the aid of the area of six hexagonal pillar type blocks of the present invention. FIG. 14 is a perspective view illustrating a construction that a retaining wall is constructed with a stable downward weight center type block according to the present invention. FIG. 15 is a cross sectional view illustrating a stable downward weight center type block according to the present invention. FIG. 16 is a view illustrating a weight center of a stable downward weight center type block according to the present invention. FIG. 17 is a plane view illustrating a stable downward weight center type block according to the present invention. FIG. 18 is a cross sectional view illustrating a construction that a repose angle inclination type block is constructed at the lower most portion of a stable downward weight center type block according to the present invention. FIG. 19 is a plane view illustrating an example that a stable downward weight center type block is constructed in a curved shape according to the present invention. FIG. 20 is a view illustrating another type of a stable downward weight center type block according to the present invention. FIG. 21 is a view illustrating further another type of a stable downward weight center type block according to the present invention. FIG. 22 is a perspective view illustrating a counter fort type retaining wall according to the present invention. FIG. 23 is a perspective view illustrating a flower garden type retaining wall according to the present invention. FIG. 24 is a perspective view illustrating a pillar mixed type retaining wall according to the present invention.

As shown in FIGS. 4 to 6, when constructing a retaining wall, it is constructed in such a way to stacking a hexagonal pillar type block 20 and a hexagonal multilayer interlocking block 10 to multiple rows in a vertical direction.

Figure 2:
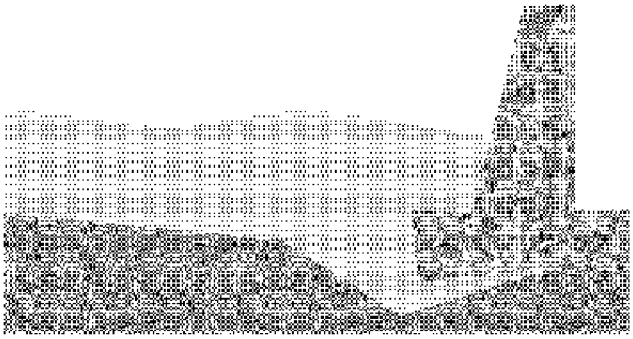
Figure 3:
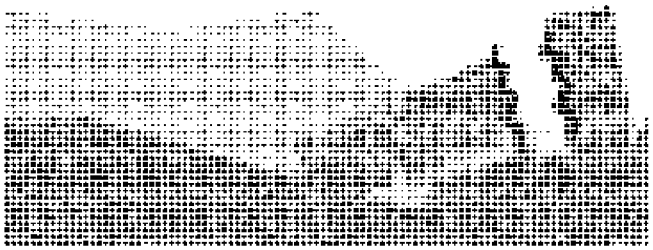

On an outer circumferential surface of the hexagonal multilayer interlocking block 10 is provided a plurality of interlocking lock S-shaped connection parts 11, so another neighboring hexagonal multilayer interlocking block 10 is connected and engaged via the S-shaped connection part 11. The thusly engaged hexagonal multilayer interlocking block 10 is engaged to move upwards and downwards. As shown in FIGS. 2*a* to 2*c*, when the lower side of the retaining wall or the embankment erodes, the hexagonal pillar type block 20 or the hexagonal multilayer interlocking block 10 lowers and fills the eroded portion.

For the embankment near sea, when building the embankment with the block which is movable in the vertical direction in the engaged state, namely, the block like the hexagonal pillar type block 20 or the hexagonal multilayer interlocking block 10, the foundation pothole portion due to the erosion of seawater can be filled up with the above mentioned blocks.

FIG. 14 shows the hexagonal multilayer interlocking block 10.

The hexagonal multilayer interlocking block 10 is a hollow interlocking block having an outer circumferential surface with the areas of six hexagonal pillar type blocks 20.

Here, the hexagonal pillar type block 20 is a hexagonal pillar shaped block with a circular hole 21 in its center, and on each hexagonal surface is formed the S-shaped connection part 23 in the longitudinal direction. The S-shaped connection part 23 consists of a longitudinal direction protrusion 23*a* protruded outwards from the hexagonal surface 22, and a longitudinal direction groove 23*b* formed inwards about the hexagonal surface 22.

The hexagonal multilayer interlocking block 10 increases its weight by filling soil and sand, gravel, concrete, etc. into the interior in the middle of the construction or after the construction. As shown in FIGS. 10 to 12, it might be built in a stair shape.

FIGS. 14 to 16 are views illustrating a construction that a retaining is wall is built with a stable downward weight center block. In other words, the stable downward weight center type block 30 is a block formed of three partitioned spaces each passing through from the top to the bottom. As shown in FIG. 17, there are inner and outer partition portions 32 and 33 formed about the center partition portion 31.

At both sides of the center partition portion 31 is formed a center S-shaped connection part 31*a* for thereby being engaged with a neighboring block.

At both sides of each of the inner and outer partition portions 32 and 33 is formed upper and lower S-shaped connection parts 32*a* and 33*a* for thereby being engaged with a neighboring block, respectively.

Both sides of each of the inner and outer partition portions 32 and 33 are formed with an angle $\alpha$ narrower than both sides of the center partition portion 31, so, as shown in FIG. 19, it is possible to connect in a curves shape when a plurality of the stable downward weight center type blocks 30 are connected with each other.

The stable downward weight center type block 30 partitioned into multiple spaces is constructed as shown in FIG. 15, and the inner partition portion 32 neighboring with the inclination surface is filled with a mixture of gravel, sand or soil and sand up to its top, and the center partition portion 31 is filled with the same up to its middle portion, and the outer partition portion 33 is is filled with the by ⅓ of the height of the retaining wall for thereby completing a retaining wall. As the retaining wall is constructed by filing gravel, sand or soil and sand in the stair shape, the weight center moves downwards as shown in FIG. 10*b*, so a retaining wall with a very stable structure can be made.

The masses by the material per 1 $m^3$ filled in the above mentioned method are shown in Table 1.

TABLE 1

| Kinds | Weight (tons) | Remarks |
|---|---|---|
| Rocks, stones | 2.1-2.5 | |
| Concrete | 2.3-2.4 | |
| Gravel | 1.9-2.2 | Not tramped |
| Sand | 1.8-2.0 | Not tramped |
| Ordinary soil and sand | 1.6-1.7 | Not tramped |

FIG. 13 is a cross sectional view illustrating another type of a stable downward weight center type block according to the present invention, and at a side surface of a longitudinal direction of the inner partition portion 32 of the stable downward weight center type block 30 is provided a longitudinal S-shaped connection part 32*b* engaged with the hexagonal pillar type block 20.

FIG. 14 is a cross sectional view illustrating further another type of a stable downward weight center type block according to the present invention, and at a side surface of a longitudinal direction of the outer partition portion 33 of the stable downward weight center type block 30 is provided a longitudinal S-shaped connection part 33*b* engaged with the hexagonal pillar type block 20.

As described above, the hexagonal multilayer interlocking block 10 is constructed in such a way that a S-shaped protrusion portion fits the groove portion in a vertical direction for thereby automatically preventing the formation of the foundation potholes formed as the blocks move to the empty spaces when spaces are formed in the ground due to waves or rainwater. The retaining wall construction system using a stable downward weight center type block 30 has features in that stability can be maximized on engineered geometric and structural basis. The heavier materials used for the filling of the block 30 are filled into the lower side and the inner side of the structure for thereby preventing an inversion.

As shown in FIG. 18, at the lower most portion of the stable downward weight center type block 30 where a retaining wall is constructed in multiple layers, the height "h" at the side of the inner partition part 32 which is at the side of the retaining wall is lower than the height "H" at the side of the outer partition portion 33, so the repose angle inclination type lower block 40 with a repose angle β inclined toward the retaining wall with respect to a vertical line is constructed for thereby constructing a retaining wall.

As shown in FIG. 22, the retaining wall is a counter fort retaining wall comprising a main retaining wall 51 constructed with a plurality of hexagonal pillar type blocks 20, and the main retaining wall 51 is inclined toward the backside, and a plurality of constructed counter fort retaining walls 50 are perpendicular direction with respect to the main retaining wall 51.

As shown in FIG. 23, the retaining wall is a flower garden type retaining wall comprising a main retaining wall 51 constructed with a plurality of hexagonal pillar type blocks 20, and a plurality of flower garden type retaining walls 60 constructed for the main retaining wall 51 to form a plurality of flower gardens at the backside.

As shown in FIG. 24, the retaining wall is a pillar mixed retaining wall comprising a main retaining wall 51 constructed with a plurality of hexagonal pillar type blocks 20, and a pillar type retaining wall 70 forming a plurality of pillars with seven hexagonal pillar type blocks 20 at certain intervals at the backside.

As described above, the detailed embodiments have been described in the disclosure of the present invention, and it is obvious that the present invention can be modified by an ordinary person skilled in the art, and such modified embodiments belong to the technical concepts of the claims of the present invention.

The invention claimed is:

1. A retaining wall construction system for preventing tsunamis and flood damages, comprising:

a hexagonal interlocking block having a circular hole in its center and S-shaped connection part having a protrusion protruding outward and a groove inward, the protrusion and groove being formed in a symmetric radial form;

an outer circumferential surface having a S-shaped connection part provided to receive a plurality of hexagonal interlocking blocks, each one of the plurality of interlocking blocks is engaged using the S-shaped connection part, wherein the plurality of hexagonal interlocking blocks are stacked in a longitudinal direction and each layer of the interlocking blocks being locked to prevent lateral movement and to allow the interlocking blocks moving upwards and downwards via the S-shaped connection part, wherein the hexagonal interlocking block and the outer circumferential surface are configured to fill an eroded portion by moving each layer of the interlocking blocks downward to the eroded portion.

2. A retaining wall construction system for preventing tsunamis and flood damages, comprising:

a stable downward weight center type block partitioned into three spaces each partitioned block passing through from the top to the bottom, and inner and outer partition portions are partitioned based on a center partition portion, and a center S-shaped connection part is formed at both sides of the center partition portion to engage with a neighboring block, and inner and outer partition portions are formed based on the center partition portion, wherein each side of the both inner and outer partition portions is formed with angle narrower than the angle of each side of the center partition portion for stably connecting downward weight center type blocks in a curved shape, and wherein at a side surface of a longitudinal direction of the inner partition portion of the stable downward weight center type block being provided to engage a longitudinal direction S-shaped connection part with a hexagonal pillar type block.

3. The system of claim 2, further comprising:

a repose angle inclination type lower block provided at the lower most portion of the stable downward weight center type block in which a retaining wall is constructed in multiple layers, and the height "h" at the side of the inner partition portion at the side of the retaining wall is lower than the height "H" at the side of the outer partition portion, and a repose angle β to inclined toward the retaining wall with respect to a vertical line is provided in the repose angle inclination type lower block.

4. A method for constructing a retaining wall construction system of claim 2, the method comprising:

partitioning the stable downward weight center type block into multiple spaces;

mixing gravel, sand or soil and sand;

filling the mixture into the inner partition part near an inclined surface up to the top of a retaining wall;

filling the mixture into the center partition part up to the middle of the retaining wall; and filling the mixture into an outer partition part up to ⅓ of the height of the retaining wall, wherein the weight center of the retaining wall is stabilized downwards.

* * * * *